United States Patent [19]

Kennedy

[11] Patent Number: 4,869,390

[45] Date of Patent: Sep. 26, 1989

[54] SPILL PROOF CUP

[76] Inventor: Daniel Kennedy, 137 Mulberry St., Pawtucket, R.I. 02860

[21] Appl. No.: 276,289

[22] Filed: Nov. 25, 1988

[51] Int. Cl.[4] ..... A47G 19/00

[52] U.S. Cl. ..... 220/90.4; 229/1.5 B

[58] Field of Search ..... 220/90.4, 83; 229/103.1, 1.5 B

[56] References Cited

U.S. PATENT DOCUMENTS

| | | | |
|---|---|---|---|
| 2,914,214 | 11/1959 | Messinger | 220/90.4 |
| 3,128,029 | 4/1964 | Price et al. | 229/1.5 B |
| 3,850,361 | 11/1974 | Day et al. | 229/1.5 B |
| 4,052,037 | 10/1977 | Mair et al. | 229/1.5 B X |
| 4,055,273 | 10/1977 | Jones | 220/90.4 X |
| 4,170,237 | 10/1979 | Epstein | 220/90.4 X |
| 4,407,425 | 10/1983 | Combs | 220/103.1 X |
| 4,607,755 | 8/1986 | Andreozzi | 220/90.4 X |
| 4,714,173 | 12/1987 | Ruiz | 220/90.4 |

*Primary Examiner*—Steven M. Pollard

*Attorney, Agent, or Firm*—Barlow & Barlow Ltd.

[57] ABSTRACT

A non-spill container has a lower portion that holds less liquid than the upper portion and is provided with a closure that has a tube fitted therein that normally extends downwardly into the container. A straw may be placed in the tube for the withdrawal of liquid, the tube being of a size sufficient so that venting is automatically provided.

2 Claims, 1 Drawing Sheet

SPILL PROOF CUP

BACKGROUND OF THE INVENTION

The present invention is directed to a non-spillable drinking container and is particularly useful in situations where the user is confined to a bed. In the past, there has been disclosed a variety of non-spillable liquid drinking containers that are particularly usable with straws as, for example, in the Talbert patent, U.S. Pat. No. 3,173,566, where a straw is inserted into a static tube that has a plurality of openings and which is primarily designed to regulate the rate of withdrawal of the liquid. Other concepts are seen in the Rains patent, U.S. Pat. No. 3,556,341, where the top closure has an integral elongated member into which a straw may be placed and in the Lottick patent, U.S. Pat. No. 4,494,668, where a container is disclosed that has a drinking staw or tube that is attached to an expandable sealing bellows that is made integral with the cap closure. The prior art does not disclose a non-spillable drinking container with a combined vent and withdrawal tube which, when properly filled, regardless of its position, will not allow the liquid to be poured therefrom nor one which additionally has the advantage of being easily cleaned.

SUMMARY OF THE INVENTION

A non-spillable drinking container that has a bottom wall and a side wall rising therefrom which is slightly tapered from the bottom wall to an outwardly extending step, shoulder or ridge and thence to an upper wall portion that defines a larger capacity than the lower portion. A closure in the form of a cap is fastened or is screwed on to the upper edge of the upper wall and has an opening therethrough into which a tube is placed, which tube extends into the container to approximately the level of the ridge. The arrangement is such that when the container is filled to the ridge, the upper wall portion is sufficiently large so that the liquid level will never rise to the end of the tube even when the cup is completely inverted nor will the liquid come out of the tube even when the cup is at an angle.

DESCRIPTION OF THE PREFERRED EMBODIMENT

Figure 1:
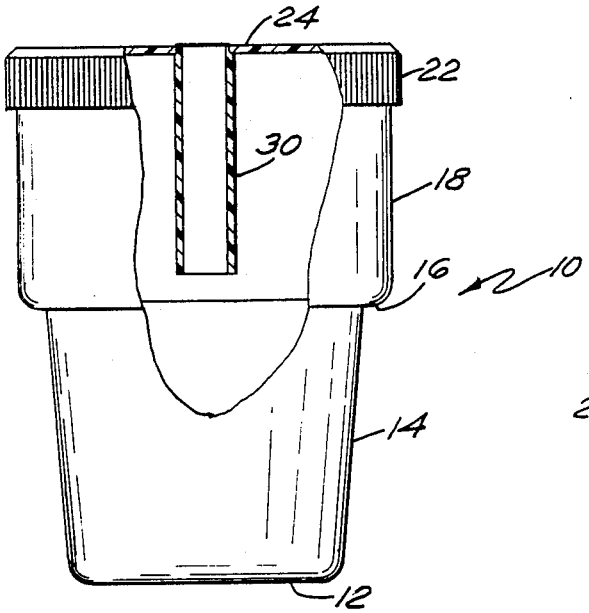
FIG. 1 is an elevational view partly broken away showing the non-spillable drinking container assembled in accordance with the present invention.
Figure 2:
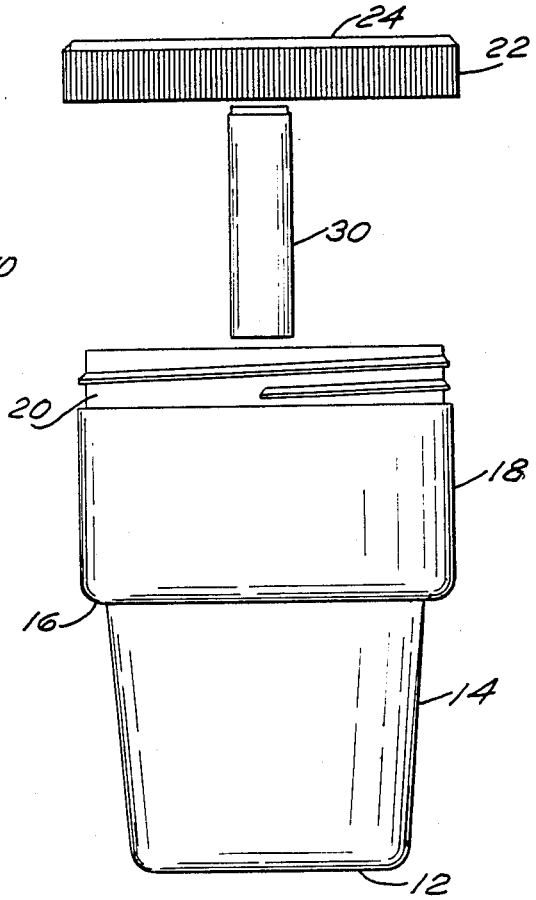
FIG. 2 is a detached perspective view of the assembly of the non-spillable drinking container.
Figure 3:
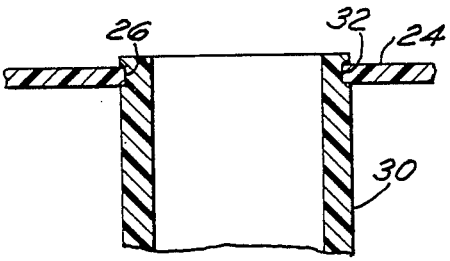
FIG. 3 is an enlarged cross-sectional view of the connection of the tube and the top wall of the closure cap.
Figure 6:
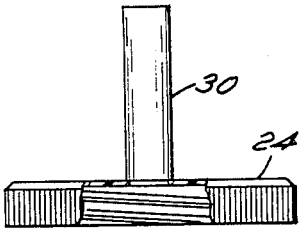
FIG. 6 is a view of the cap with the tube in inverted position.

Referring now to the drawings, the drinking container is esentially a cylindrical unit that consists of two concentric portions, there being a large upper portion and a smaller lower portion, the latter being about one-half of the capacity of the large upper portion. Specifically the container generally indicated at 10 has a bottom wall 12 and a lower tapering side wall 14 that rises therefrom. At the upper end of the side wall 14 there is provided a step, shoulder or ridge 16 and the wall continues as an upper side wall portion 18 that terminates, as illustrated, in a male thread section 20. Other closures may be used, as for example a snap fit. There is provided a closure means or cap which has a side wall 22 and a top wall 24. The top wall 24 is provided with an opening shown in more detail in FIG. 3, the opening being designated 26, and into this opening there is received a tubular member 30 which has a notch 32 near its terminal end, the notch being of a size to fit into the opening 26 and preferably to snap therein. It is advantageous to have the tube snap into the top wall for, in its normal non-spillable condition, the container will have the tube extending down into the interior thereof. But, on some occasions, the tube may be snapped out and reversed so as to protrude from the top wall, the container in this case being used as a normal container without the non-spillable feature. To achieve this, the closure is preferably made of a material that will deform and will tightly engage the recess to provide a liquid tight seal.

Figure 4:
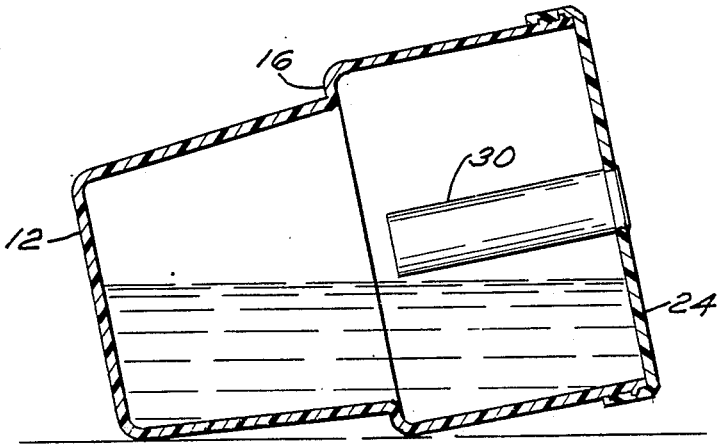
FIG. 4 is an illustrative view in cross-section showing the manner in which the liquid is retained in the container.
Figure 5:
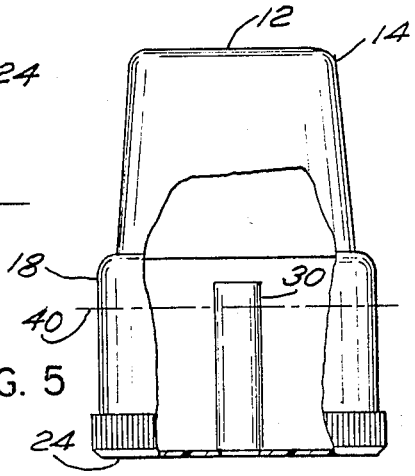
FIG. 5 is a view of a cup in inverted position showing the liquid level in this position.

It should also be recognized that the container can be provided with other cross-sectional shapes which would include, but are not limited to, hexagonal, octagonal, rectangular or square, for example. The primary concern of the container is to provide one that has an increasing cross-sectional area at the upper portion thereof so as to provide a larger volume capacity than at the lower portion. In this fashion, the amount of liquid which is added to the point where the step or ridge is provided will be smaller than that that can be achieved in the upper part of the container, even when the same is in an inverted or other positions. For example, by referring to FIG. 4, it will be seen that the liquid, when the container is resting on its side and which has been filled to the ridge level, will lie below the inner end of the tube 30. By referring to FIG. 5 it will be seen that the liquid in the totally inverted position is only approximately half way up the upper wall portion 18. When the container is fully inverted, the liquid will come to the broken line indicated at 40.

In use, if the container 10 is filled to the level at the ridge or step 16, it will permit the beverage to remain in the container without spilling and when it is desired to remove the beverage, a straw would be placed down through the opening and through the tube 30 to contact the liquid so that the user may withdraw the same.

I claim:

1. A non-spill container having a bottom wall, an upwardly tapering lower side wall with an outwardly extending step defining a lower portion, and an integral upper cylindrical side wall defining a larger diameter portion than the lower portion, said larger diameter portion having a rim defining a mouth, a closure means tightly engaging the rim, said closure having a central opening therethrough, a tube removably fitted into the opening of a length substantially the same as the length of the upper side wall, the volume defined by the lower portion being approximately half the volume of the larger diameter portion whereby when the container is filled to the step and then inverted, the liquid can not escape through the tube, said closure having a substantially flat surface and the opening therethrough is defined by a lip edge, the tube being provided with a recess adjacent one end thereof which recess engages the lip of the opening in the closure.

2. A non-spill container as in claim 1 wherein the closure is made of a material that will deform slightly so that the tube and closure have a liquid tight seal.

* * * * *